US008051568B2

(12) United States Patent
Moody et al.

(10) Patent No.: US 8,051,568 B2
(45) Date of Patent: Nov. 8, 2011

(54) GRATE COVER APPARATUS AND METHOD

(76) Inventors: Gary L. Moody, Hendersonville, TN (US); Thomas H. Happel, Cocoa, FL (US)

( * ) Notice: Subject to any disclaimer, the term of this patent is extended or adjusted under 35 U.S.C. 154(b) by 1138 days.

(21) Appl. No.: 11/808,936

(22) Filed: Jun. 13, 2007

(65) Prior Publication Data

US 2008/0006568 A1 Jan. 10, 2008

Related U.S. Application Data

(60) Provisional application No. 60/812,920, filed on Jun. 13, 2006.

(51) Int. Cl.
*E03F 5/06* (2006.01)

(52) U.S. Cl. ..... 29/896.62; 210/747.3; 210/164; 210/691

(58) Field of Classification Search ..... None
See application file for complete search history.

(56) References Cited

U.S. PATENT DOCUMENTS

| | | | | | |
|---|---|---|---|---|---|
| 2,636,572 | A * | 4/1953 | Fleisher | 55/443 |
| 3,003,643 | A * | 10/1961 | Thomas | 210/491 |
| 3,067,504 | A * | 12/1962 | Lubben et al. | 29/419.1 |
| 3,793,692 | A * | 2/1974 | Tate et al. | 29/896.62 |
| 4,483,640 | A * | 11/1984 | Berger et al. | 405/15 |
| 4,594,157 | A * | 6/1986 | McGowan | 210/163 |
| 4,838,732 | A * | 6/1989 | Clark et al. | 405/52 |
| 4,988,234 | A * | 1/1991 | Henkel et al. | 405/36 |
| 5,071,177 | A * | 12/1991 | Spiess et al. | 292/91 |
| 5,375,940 | A * | 12/1994 | Kobayashi | 404/2 |
| 5,405,539 | A * | 4/1995 | Schneider | 210/747.3 |
| 5,632,888 | A * | 5/1997 | Chinn et al. | 210/163 |
| 5,702,595 | A * | 12/1997 | Mossburg, Jr. | 210/163 |
| 5,725,782 | A * | 3/1998 | Chinn et al. | 210/767 |
| 5,788,849 | A * | 8/1998 | Hutter et al. | 210/163 |
| 5,843,306 | A * | 12/1998 | Singleton | 210/163 |
| 5,948,250 | A * | 9/1999 | Middleton | 210/232 |
| 5,954,952 | A * | 9/1999 | Strawser, Sr. | 210/164 |
| 6,017,166 | A * | 1/2000 | Mossburg, Jr. | 404/5 |
| 6,808,623 | B2 * | 10/2004 | Harris et al. | 210/164 |
| 7,074,326 | B2 * | 7/2006 | Singleton | 210/163 |
| 7,266,926 | B2 * | 9/2007 | Karow | 52/103 |
| 7,313,889 | B2 * | 1/2008 | Karow | 52/103 |
| 7,404,690 | B2 * | 7/2008 | Lukasik et al. | 404/36 |
| 7,455,474 | B2 * | 11/2008 | Tievant et al. | 404/25 |
| 7,481,921 | B2 * | 1/2009 | Kent | 210/164 |
| 7,524,414 | B1 * | 4/2009 | Barragan | 210/163 |
| 7,549,820 | B1 * | 6/2009 | Happel | 404/4 |
| 7,730,685 | B1 * | 6/2010 | Keene | 52/302.4 |
| 7,879,233 | B2 * | 2/2011 | Shaw et al. | 210/164 |
| 2001/0047955 | A1 * | 12/2001 | Chinn et al. | 210/164 |
| 2002/0130070 | A1 * | 9/2002 | Roesner | 210/163 |
| 2002/0130083 | A1 * | 9/2002 | Middleton et al. | 210/660 |
| 2003/0053862 | A1 * | 3/2003 | Shaw et al. | 405/40 |
| 2003/0217955 | A1 * | 11/2003 | Strawser, Sr. | 210/163 |
| 2004/0188357 | A1 * | 9/2004 | Moore | 210/747 |
| 2004/0200767 | A1 * | 10/2004 | Singleton | 210/163 |
| 2005/0000872 | A1 * | 1/2005 | Middleton et al. | 210/163 |
| 2005/0230317 | A1 * | 10/2005 | Belasco et al. | 210/691 |
| 2007/0131597 | A1 * | 6/2007 | Chen | 210/164 |
| 2007/0138074 | A1 * | 6/2007 | Howard | 210/163 |

(Continued)

*Primary Examiner* — Robert James Popovics
(74) *Attorney, Agent, or Firm* — William M. Hobby, III

(57) ABSTRACT

The present invention relates to a temporary grate cover apparatus for placement over a storm water grate to filter sediment and trash from entering the storm drain during a construction project and to a method of making and attaching a storm water grate cover to a storm water grate.

5 Claims, 2 Drawing Sheets

U.S. PATENT DOCUMENTS

2007/0295652 A1* 12/2007 Kent ..... 210/164
2008/0006568 A1* 1/2008 Moody et al. ..... 210/164
2008/0145150 A1* 6/2008 Shaw et al. ..... 405/52
2008/0149544 A1* 6/2008 Shaw et al. ..... 210/163
2008/0296211 A1* 12/2008 Swan ..... 210/163
2010/0006487 A1* 1/2010 Belasco ..... 210/164
2010/0288684 A1* 11/2010 Lopez ..... 210/163
2011/0049027 A1* 3/2011 Rueda ..... 210/163

* cited by examiner

GRATE COVER APPARATUS AND METHOD

This application claims the benefit of U.S. Provisional Application No. 60/812,920, filed Jun. 13, 2006.

BACKGROUND OF THE INVENTION

This invention relates to a temporary grate cover for placement over a storm water grate to filter sediment and trash from entering the storm drain during a construction project and to a method of making the temporary grate cover.

In the past, there have been temporary grate filters placed under the grate to collect sand and trash from a construction project so that the grate has to be removed to retrieve the collected sand and trash. This commonly allows sand collected in a temporary grate to fall into the drain when removing the grate to remove the filter, thereby defeating the purpose of the filter. The grates covering drains typically are heavy so that removing the grate for cleaning the temporary grate filter can result in an accident to the person moving the grate by hand. The present temporary grate cover is easily installed without removing the grate and may be used many times and is easily cleaned without removing the grate.

SUMMARY OF THE INVENTION

A storm water grate cover for attaching over a storm water grate has an expanded metal screen sized to fit over a predetermined storm water grate. The expanded metal screen has a high flow monofilament fabric filter sized to fit over the expanded metal screen and is attached thereto to form a storm water grate cover. A plurality of j-bolts or toggle bolts are shaped to removably attach the storm water grate cover to the storm water grate with a threaded nut fastener removably attached thereto over the storm water grate cover which may have an enlarged washer to lock the storm water grate cover to the storm water grate. The storm water grate cover can be quickly attached to a storm water grate to filter sediment and trash from entering a storm drain. The high flow monofilament fabric may be a woven polyethylene fabric and may have a generally right angle bend therein to cover the storm water grate in a storm drain curbside opening. The storm water grate cover can have a U-shaped edge trim overlapping the edge of the expanded metal screen and over the edge of the high flow monofilament filter fabric and can be attached to the high flow monofilament filter fabric with an adhesive. The edge trim can also have a plurality of barbs thereon engaging the filter cup over the expanded metal screen with the plurality of bars being located on both inside walls of the U-shaped trim. The expanded metal screen may have a generally diamond shaped screen openings which may be about 1¾ inches in length. A hydroprobic oil absorbent boom may be attached to the perimeter of the storm water grate cover.

A method of making and attaching a storm water grate cover to a storm water grate includes the steps of selecting an expanded metal screen sized to fit over a predetermined storm water grate and selecting a high flow monofilament fabric filter sized to fit over the selected expanded metal screen and then attaching the high flow monofilament fabric filter to the selected expanded metal screen. The process includes selecting a U-shaped edge trim and attaching it over the edge of the selected expanded metal screen and over the edge of the high flow monofilament fabric filter to form a storm water grate cover. Bolts are selected which are shaped to attach the storm water grate cover to the storm water grate and removably attach the storm water grate cover to the storm water grate so that a storm water grate cover can filter sediment and trash from entering a storm drain. The method also includes the steps of selecting a woven polyethylene fabric and of bending a storm drain grate cover to form a generally right angled bend therein to cover the storm grate and the storm drain curbside opening. The step of selecting a U-shaped edge trim includes selecting a U-shaped edge trim having a plurality of barbs thereon engaging a filter cover over the expanded metal screen and easily attaching the selected U-shaped edge trim to the filter cover over the expanded metal screen. The process also includes selecting attaching a hydroprobic oil absorbent boom to the perimeter of the storm water grate cover.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
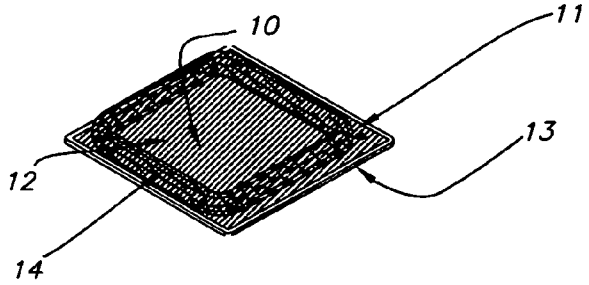
FIG. 1 is a perspective view of a grate cover in accordance with the present invention.
Figure 2:
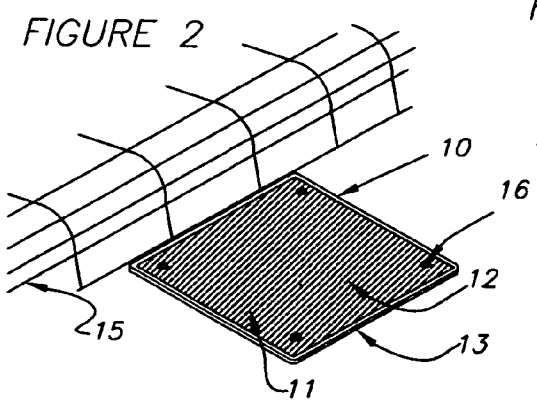
FIG. 2 is a perspective view of the grate cover of FIG. 1 attached over the grate of a storm water drain.
Figure 3:
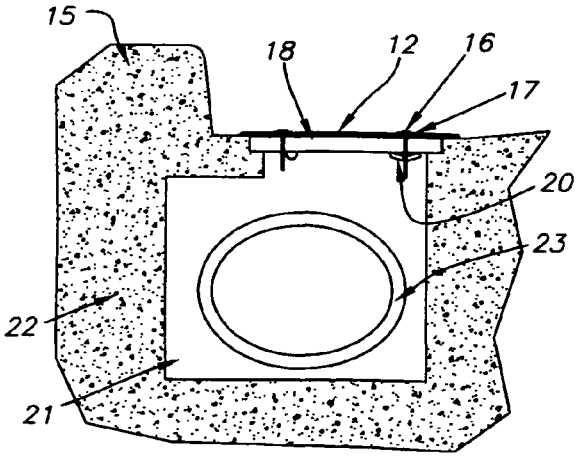
FIG. 3 is a sectional view of a grate cover in accordance with FIGS. 1 and 2 attached to a grate over a storm water drain inlet.

Referring to the drawings, FIGS. 1-3, a temporary grate cover 10 is illustrated having a piece of flattened expanded metal 11 having the characteristic diamond pattern and sized to be slightly larger than the storm water grate. The flattened expanded metal may be made of a stainless steel to resist corrosion and has openings that are diamond shaped which may be about ¾"×1¾" as desired. The flattened expanded metal 11 is covered with a geotextile fabric 12. The fabric is a filter weave high flow monofilament fabric, such as a woven polyethylene fabric. The fabric extends over the edge of the flattened expanded metal which has already been cut to size to fit over a predetermined storm water grate. The fabric cover 12 has a U-shaped locking trim edge 13 for holding the fabric 12 to the expanded metal. The fabric is wrapped around the flattened expanded metal and the U-shaped locking trim edge is applied to the edge of the fabric and metal to secure them together. A fast drying construction adhesive is applied to the fabric 12 and metal 11 along the edge to bind the fabric U-shaped locking trim edge and flattened expanded metal together. FIG. 1 also illustrates a hydrophobic oil absorbent boom 14 attached to the fabric 12 around the perimeter portion of the grate cover 10 for collecting oil which might be running off with the drain water. The geotextile fabric 12 is a 40 sieve size but this can vary depending on where the grate cover is to be utilized.

FIGS. 2 and 3 illustrates the grate cover 10 placed over a storm water drain inlet grate adjacent a curb 15. In this grate inlet, there is no curb inlet for the storm water drain. The grate cover 10 is attached to the grate with a plurality of toggle or "J" bolts 16. As seen in FIG. 3, the toggle bolts 16 may have a large washer 17 fitting over the fabric 12 and through the flattened expanded metal 11 and may extend through a storm water drain inlet grate 18. Bolt 16 has the toggle 20 extending underneath which is threaded to tighten it onto the grate 18. The storm water drain 21 is formed in the concrete 22 with the curb 15 and may have a drain pipe 23 located therein.

Figure 4:
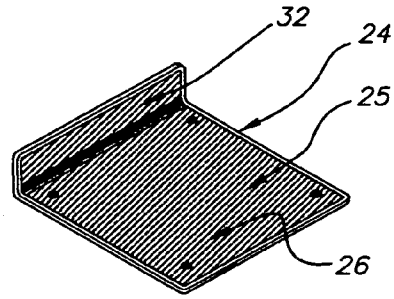
FIG. 4 is another embodiment of a grate cover in accordance with the present invention.

FIG. 4 illustrates a second embodiment of a temporary grate cover 24 having the flattened expanded metal base 25 covered with the geotextile woven fabric 26 and attached to a grate 27 with toggle bolts 16. In this embodiment, the curb 28 has a curb opening 30 in addition to the road opening 31 for the storm water drain inlet. In this embodiment, the temporary grate cover 24 has one side turned up to form a filtering dam 32 and may leave a slight overflow area 33 in the curb inlet 30. This embodiment has the storm water drain 34 having a drain pipe 23 positioned therein while the toggle bolts 16 are seen in FIG. 6 with the toggles 20 extending under the grate 27.

Figure 7:
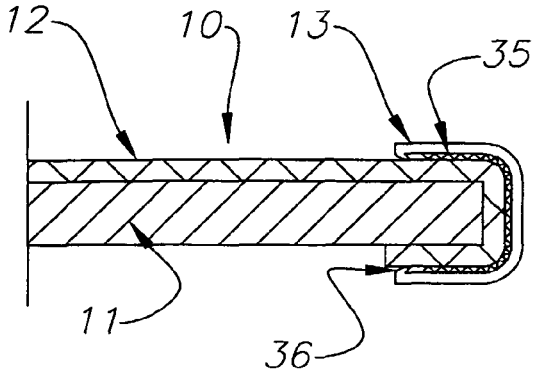
FIG. 7 is a partial sectional view of the grate cover in accordance with the present invention.
Figure 8:
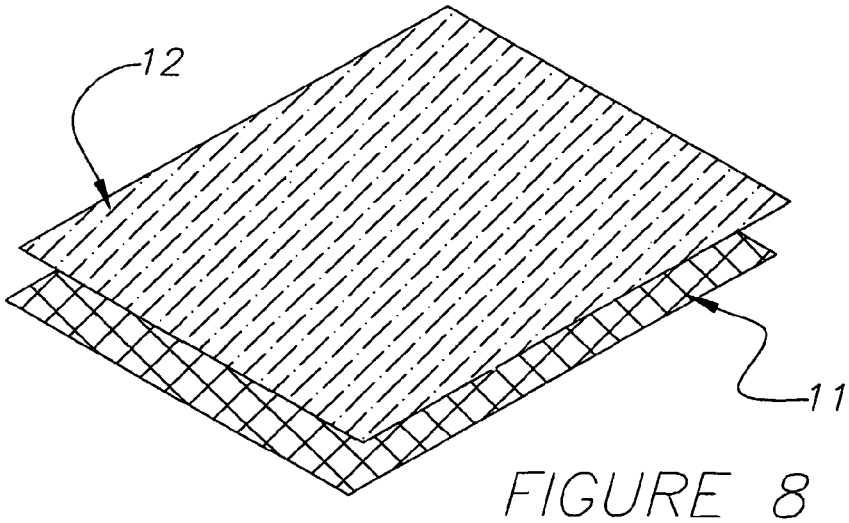
FIG. 8 is an exploded perspective of the grate cover expanded metal and fabric covering.

Turning to FIGS. 7 and 8, a portion of the filtering grate cover 10 is illustrated having the flattened expanded metal 11 having the monofilament woven filter fabric 12 positioned thereover and which has the U-shaped locking trim edge 13 locking the fabric 12 and the expanded metal 11 to the edge. The fabric 12 can be seen wrapping around the edge of the metal 11 which has been cut to a particular size as needed to cover a grate. An adhesive 35 has been applied to the edge for sealing the fabric 12 to the flattened expanded metal 11 and binding the U-shaped locking trim edge 13 together around the perimeter of the grate cover 10. The fabric 12 has been cut to a size approximately 2" larger than the expanded metal 11 in all directions so that it can be folded around the expanded metal 11 once the metal has been cut to shape. After the fabric has been folded over the edge of the metal, it is attached in place with a fast drying construction adhesive and the U-shaped locking trim edge 13 is applied around the edge of the attached filter weave fabric and flattened expanded metal 11. The edge 13 has a locking barb 36 which locks the U-shaped locking trim edge over the edge of the flattened expanded metal 11 and filter fabric 12 which is further attached with the adhesive 35. The U-shaped locking trim edge 13 can be an aluminum trim edge which is covered with a plastic and which can be removed from a roll, cut to size and easily bent to wrap around the edges of the expanded metal 11 and fabric 12 and clipped on with the barb 36.

The method of making the present grate cover includes selecting a flattened expanded metal 11, typically with diamond shaped openings, which may be sized at about ¾"× 1¾". The flattened expanded metal 11 is then cut to size for a particular size grate for a storm water drain inlet. A geotextile fabric 12 is then selected which may be a woven polyethylene fabric which may, for instance, have a 40 sieve size. The fabric 12 is cut from a roll to a size about 2" larger than the already cut flattened expanded metal 11 so that it can be placed over the flattened expanded metal and wrapped around the perimeter edges in all directions. Once the fabric is wrapped around the metal, fast drying construction adhesive 35 is then applied to the edges of the metal and onto the fabric and a U-shaped locking trim edge 13 is applied to the edges of the fabric and metal to secure them together. The U-shaped locking trim edge 13 is designed to lock onto the edge and is taken from a roll and cut to size and is a plastic covered aluminum so that it can be bent to follow the perimeter of the grate cover.

Figure 5:
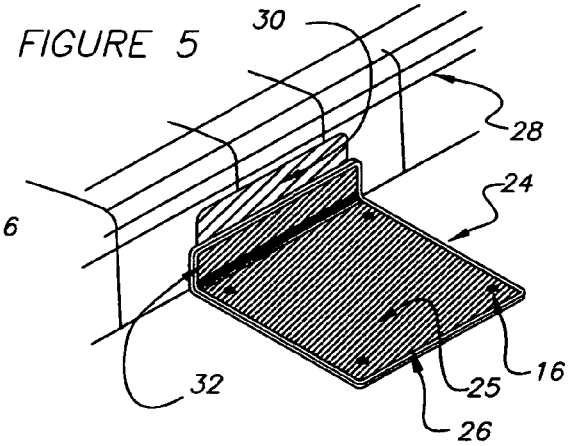
FIG. 5 is a perspective view of the grate cover of FIG. 4 placed over a storm water drain grate.
Figure 6:
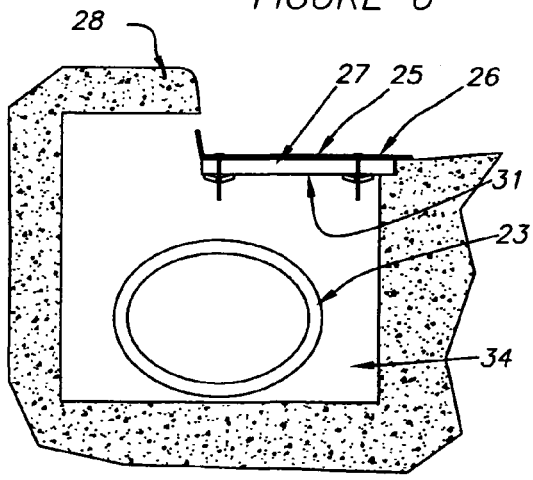
FIG. 6 is a sectional view of the grate cover of FIG. 5 attached to a storm water drain inlet grate.

In the case of the embodiment of FIGS. 4-6, the grate cover is bent to form the lip or filtering edge 32 for placement over a storm water drain inlet having a curb opening. The grate cover is then taken to a street grate where it may be attached to the grate with toggle bolts which may have a washer placed on the geotextile fabric with a bolt pushed through the fabric and through the flattened expanded metal and through the grate having the toggle end attached to the end thereof which can then be threaded to lock the toggle against the bottom of the grate to lock the grate cover to the grate. It should also be clear that a J-bolt can be used for attaching the grate cover to the grate.

It should be clear at this time that a temporary grate cover has been provided which can be with or without a hydrophobic oil absorbent boom around its perimeter and which can placed over a storm water grate to keep sediment and trash out of the storm water drain during a construction project. However, the present invention is not to be construed as limited to the forms shown which are to be considered illustrative rather than restrictive.

We claim:

1. A method of making and attaching a storm water grate cover to a storm water grate comprising the steps of:

selecting an expanded metal screen sized to fit over a predetermined storm water grate;

selecting a high flow monofilament fabric filter to keep sediment and trash out of the storm water drain, said fabric being sized to fit over said selected expanded metal screen and attaching said high flow monofilament fabric filter to said selected expanded metal screen;

selecting a U-shaped edge trim having a plurality of barbs thereon;

attaching said selected U-shaped edge trim over the edge of said selected expanded metal screen and over the edge of said high flow monofilament fabric filter to form a storm water grate cover, said barbs locking said U-shaped edge trim over the edge of said expanded metal screen and said fabric;

selecting bolts shaped to attach said storm water grate cover to a storm water grate; and removably attaching said storm water grate cover to said storm water grate; whereby a storm water grate cover can filter sediment and trash from entering a storm drain.

2. The method of making and attaching a storm water grate cover to a storm water grate in accordance with claim 1 in which the step of selecting a high flow monofilament fabric includes selecting a woven polyethylene fabric.

3. The method of making and attaching a storm water grate cover to a storm water grate in accordance with claim 1 includes the step of bending said storm drain grate cover to form a generally right angle bend therein to cover the storm drain grate and the storm drain curbside opening.

4. The method of making and attaching a storm water grate cover to a storm water grate in accordance with claim 3 including adhesively attaching said selected a U-shaped edge trim to said high flow monofilament fabric filter over said expanded metal screen.

5. The method of making and attaching a storm water grate cover to a storm water grate in accordance with claim 4 including selecting and attaching a hydrophobic oil absorbent boom to the perimeter of said storm water grate cover.

* * * * *